US007721818B2

(12) United States Patent
Inagawa et al.

(10) Patent No.: US 7,721,818 B2
(45) Date of Patent: May 25, 2010

(54) POWER TOOL HAVING A VIBRATION ISOLATING HANDLE

(75) Inventors: Hiroto Inagawa, Ibaraki (JP); Shinki Ohtsu, Ibaraki (JP); Kenji Kobori, Ibaraki (JP); Tetsuo Ebata, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/260,418

(22) Filed: Oct. 28, 2005

(65) Prior Publication Data

US 2006/0113098 A1 Jun. 1, 2006

(30) Foreign Application Priority Data

Oct. 29, 2004 (JP) ..... P2004-315029

(51) Int. Cl.
*B25G 1/01* (2006.01)
*B26B 25/00* (2006.01)
*B25F 5/02* (2006.01)

(52) U.S. Cl. ..... 173/162.2; 173/162.1; 267/137

(58) Field of Classification Search ... 173/162.1–162.2; 267/141.7, 141.3, 137; 30/381
See application file for complete search history.

(56) References Cited

U.S. PATENT DOCUMENTS 2,101,869 A * 12/1937 Noble ..... 267/137
3,911,580 A * 10/1975 Bailey ..... 30/381
4,749,049 A * 6/1988 Greppmair ..... 173/162.2
4,936,394 A 6/1990 Ohtsu
5,046,566 A * 9/1991 Dorner et al. ..... 173/162.2
5,052,500 A * 10/1991 Ohtsu ..... 173/162.2
5,072,917 A 12/1991 Pleva
5,157,807 A * 10/1992 Keller et al. ..... 16/431
5,400,860 A * 3/1995 Best et al. ..... 173/162.2
5,522,466 A * 6/1996 Harada et al. ..... 173/162.2

(Continued)

FOREIGN PATENT DOCUMENTS

DE 10248866 4/2004

(Continued)

OTHER PUBLICATIONS

Japanese Office Action, with English translation, issued in Japanese Patent Application No. 2004-315029, mailed Mar. 9, 2010.

*Primary Examiner*—Rinaldi I. Rada
*Assistant Examiner*—Lindsay Low
(74) *Attorney, Agent, or Firm*—McDermott Will & Emery LLP

(57) ABSTRACT

A power tool includes: a power tool main body; a handle holder protruding from the power tool main body; a handle extending in a protruding direction of the handle holder and having an arm portion engaging the handle holder; and an elastic body carried between the power tool main body and the handle. The handle holder has a spherical convex outer circumferential face. The arm portion surrounds the handle holder and has a spherical concave inner circumferential face. The convex outer circumferential face of the handle holder is inserted and fitted into the concave inner circumferential face. The elastic body is carried between the power tool main body and the handle around the outer circumference of the handle holder in a radial direction vertical to a protruding-direction central axis of the handle holder.

16 Claims, 6 Drawing Sheets

U.S. PATENT DOCUMENTS

| | | | | |
|---|---|---|---|---|
| 5,699,865 | A * | 12/1997 | Forderer et al. | 173/162.2 |
| 6,412,180 | B1 * | 7/2002 | Wolf et al. | 30/381 |
| 7,137,542 | B2 * | 11/2006 | Oki et al. | 173/162.2 |
| 7,217,178 | B2 | 5/2007 | Oki et al. | |
| 2002/0121384 | A1 * | 9/2002 | Saito et al. | 173/109 |
| 2004/0016082 | A1 * | 1/2004 | Yi | 16/421 |
| 2006/0166613 | A1 * | 7/2006 | Lamprecht et al. | 451/359 |
| 2006/0219419 | A1 * | 10/2006 | Sugiyama et al. | 173/162.2 |
| 2006/0258274 | A1 * | 11/2006 | Oki et al. | 451/358 |

FOREIGN PATENT DOCUMENTS

| | | |
|---|---|---|
| JP | 01-281881 | 11/1989 |
| JP | 05-169375 | 7/1993 |
| JP | 2004-249430 | 9/2004 |

* cited by examiner

POWER TOOL HAVING A VIBRATION ISOLATING HANDLE

BACKGROUND OF THE INVENTION

1. Field of the Invention

The present invention relates to a power tool such as a disk grinder, and more particularly to a vibration isolating handle in a power tool.

2. Background Art

In a portable power tool such as a disk grinder, it is common practice that a vibration proofing mechanism is provided in the joint between a power tool main body and a handle to attenuate the vibrations generated during operation to be transmitted from the power tool main body to the handle portion linked to the power tool main body. In the power tool having this vibration isolating handle, an elastic body is generally carried in the joint between the power tool main body and the handle to absorb the vibrations generated from the power tool main body. For instance, the power tool having the vibration isolating handle of this kind was disclosed in the following Japanese Patent No. 2534318.

SUMMARY OF THE INVENTION

However, in the power tool having the vibration isolating handle as disclosed in patent document 1, in view of the length in the central axis direction, the total length is longer by the size of the elastic body for vibration absorption, and further increased due to the size of a rib to demarcate a space that contains the elastic body for vibration absorption and the size of a convex portion engaged with the elastic body for vibration absorption to prevent omission of the handle. Therefore, the length of the power tool main body or the handle was longer in the direction of its center axis, whereby it was difficult to avoid the increase in the size of the power tool itself.

Also, it was required to incorporate the elastic body member divided in plural blocks into the joint between the power tool main body and the handle around the periphery of the joint of the handle, whereby there was a problem that the manufacturing assembly process of the power tool was more complex.

In addition, in the power tool having the vibration isolating handle in the patent document 1, a first contact face between one end of the elastic body and the power tool main body and a second contact face between the other end of the elastic body and the handle are planar. Therefore, when the operator holds the handle and presses a tip tool against a working plane in the operation, the handle is inclined so that a rear end portion of the handle lifts up with respect to the central axis line of the power tool main body. As a result, the elastic body is compressed between the handle and the power tool main body, and elongated in a right-angled direction to the compressed direction, causing a slippage between the first and second contact faces, resulting in a problem that the handle is subjected to a great initial deflection due to deformation of the elastic body and the slippage between both the contact faces. Thereby, since the operator loses a moderate hardness in the handle operation, there is a problem that the handle operation is so soft that the work efficiency is degraded.

In a state where the operator holds the handle and presses the power tool against the working plane during the operation, the elastic body remains deformed, and a great frictional force already acts on the contact face between the elastic body and the power tool main body or the handle, whereby even if the power tool vibrates in this state, there is hardly slippage on the contact face between the elastic body and the power tool main body or the handle, making it possible to absorb the vibrations only due to the effect of deformation of the elastic body. Generally, the handle is largely flexed by a small load owing to the effect of slippage on the contact face and the deformation of the elastic body, and indicates a flexible characteristic. On the other hand, due to the deformation of the elastic body only, the initial deflection is so small that the handle shows a relatively hard characteristic.

Shortly, though the handle shows a relatively flexible characteristic, before the working state, because there is a great initial deflection of the handle due to slippage of the elastic body on the contact face, the handle in the flexed state during the operation shows a relatively hard characteristic due to only the deformation of the elastic body. Thus, if the elastic body is made a soft structure to improve the vibration isolating characteristic during the operation, the initial deformation of the handle becomes large, so that the operator is given a vague impression, causing a problem that the operability of the handle is worse.

Moreover, if a wear occurred on the contact face due to the use for long term and a gap was gradually produced, the handle had a rattle with the power tool main body, resulting in a problem that the workability of the handle was very worse.

Accordingly, it is an object of the invention to provide a power tool having a vibration isolating handle, which has a small size and excellent workability.

It is another object of the invention to provide a power toll having a vibration isolating handle structure that has a relatively simple assembling operation.

It is a further object of the invention to provide a power toll having a vibration isolating handle with less secular change in the vibration absorption characteristic of the elastic body.

The above and other objects and new features of the invention will be more apparent from the following description of the specification and the accompanying drawings.

According to one aspect of the present invention, there is provided a power tool comprising a power tool main body, a handle holder protruding from the power tool main body, a handle extending in a protruding direction of the handle holder and having an arm portion engaging the handle holder, and an elastic body carried between the power tool main body and the handle, characterized in that the handle holder has a spherical convex outer circumferential face, and the arm portion surrounding the handle holder has a spherical concave inner circumferential face, the convex outer circumferential face of the handle holder being inserted and fitted into the concave inner circumferential face of the arm portion, and the elastic body is carried between the power tool main body and the handle around the outer circumference of the handle holder in a radial direction vertical to the central axis of the handle holder in the protruding direction.

According to another aspect of the invention, means for preventing the rotation around the central axis of the handle holder in the protruding direction is provided between the handle holder and the arm portion.

According to a further aspect of the invention, the handle holder protrudes from a circular pedestal portion of the power tool main body that is protuberant in the protruding direction of the handle holder, and the rotation prevention means of the handle holder comprises a groove portion formed in the circular pedestal portion and a projection portion of the arm portion fitted into the groove portion.

According to a further aspect of the invention, the rotation prevention means of the handle holder comprises a depression portion formed in parallel to the central axis of the handle holder in the protruding direction in a part of the convex outer circumferential face of the handle holder, and a projection portion formed on the concave inner circumferential face of the arm portion to be fitted into the depression portion.

According to a second aspect of the invention, there is provided a power tool comprising a power tool main body, a handle holder protruding from the power tool main body, a handle extending in a protruding direction of the handle holder and having an arm portion engaging the handle holder, and an elastic body carried between the power tool main body and the handle, characterized in that the handle holder has a spherical convex outer circumferential face, and the arm portion surrounding the handle holder has a spherical concave inner circumferential face, the convex outer circumferential face of the handle holder being inserted and fitted into the concave inner circumferential face of the arm portion, at least two or more first depression portions that are separated and extend in the direction parallel to the central axis of the handle holder in the protruding direction are formed on a part of the convex outer circumferential face of the handle holder, and at least two or more second depression portions that are separated are formed on the concave inner circumferential face of the arm portion corresponding to the first depression portions, in which when the first depression portions and the second depression portions are contacted, at least two or more separated holes portions with the handle holder and the arm portion as the side walls are formed, a slide switch contained within the handle and slidable in a direction of the central axis of the handle holder in the protruding direction is formed, and a projection portion fitted into the hole portion formed by the handle holder and the arm portion is mounted on the slide switch, and the elastic body is carried between the power tool main body and the handle around the outer circumference of the handle holder in a radial direction vertical to the central axis of the handle holder in the protruding direction.

According to a third aspect of the invention, there is provided a power tool comprising a power tool main body, a handle holder protruding from the power tool main body, a handle extending in a protruding direction of the handle holder and having an arm portion engaging the handle holder, and an elastic body carried between the power tool main body and the handle, characterized in that the elastic body is carried between the power tool main body and the handle around the outer circumference of the handle holder in a radial direction vertical to the central axis of the handle holder in the protruding direction, and a first contact face between one end of the elastic body and the power tool main body and a second contact face between the other end of the elastic body and the handle are provided with the concave and convex fitting portions that can be fitted together.

According to another aspect of the invention, the first contact face and the second contact face are radially provided with at least two or more the concave and convex fitting portions.

According to a further aspect of the invention, the first contact face and the second contact face are circumferentially provided with at least two or more concave and convex fitting portions within an angle of 45°.

According to a further aspect of the invention, the length of the elastic body in the direction parallel to the central axis of the handle holder is greater than the spaced distance between the first contact face and the second contact face, whereby the elastic body is constrained between the first contact face and the second contact face.

According to a further aspect of the invention, a slide member is disposed on the convex outer circumferential face of the handle holder or the concave inner circumferential face of the arm portion.

According to a further aspect of the invention, the handle is composed of a plurality of handle members divided in the direction parallel to the central axis of the handle holder.

According to a further aspect of the invention, the elastic body has a shape of ring in cross section in the radial direction vertical to the central axis of the handle holder.

According to a further aspect of the invention, a projection portion projecting in the direction of the power tool main body is disposed at a position on the outer diameter side of the arm of the handle and on the inner diameter side of the elastic body, and has a gap between a distal end of the projection portion and the power tool main body.

According to a further aspect of the invention, the length of the elastic body in the direction parallel to the central axis of the handle holder is greater than the size of the gap for the elastic body carried and contained between the power tool main body and the handle, whereby the concave and convex portions contacting the handle or the power tool main body are formed.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
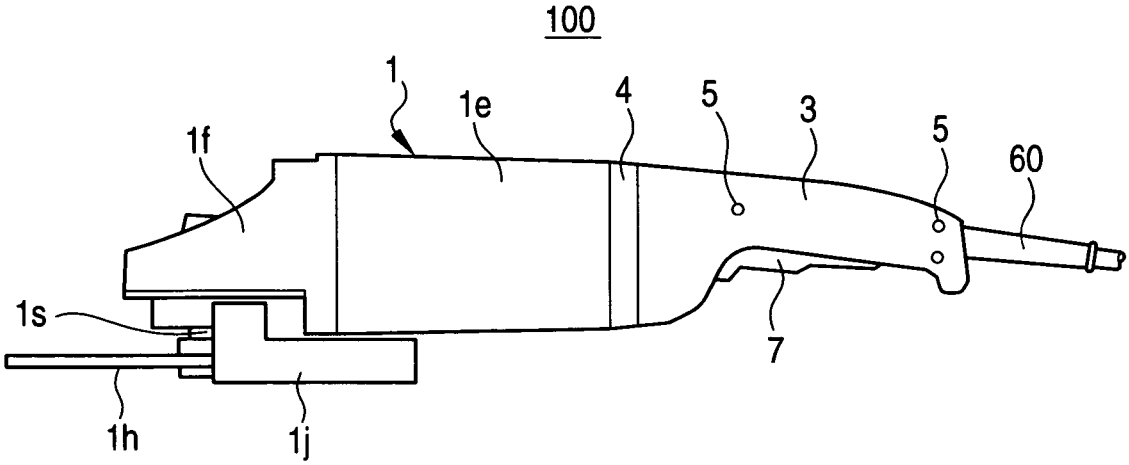
FIG. 1 is an overall appearance view (side view) of a power tool according to a first embodiment of the present invention.

The embodiments of the present invention will be described below in detail with reference to the drawings. The same or similar parts are designated by the same reference numerals throughout the drawings to explain the embodiments. The duplicate explanation is omitted.

Figure 2:
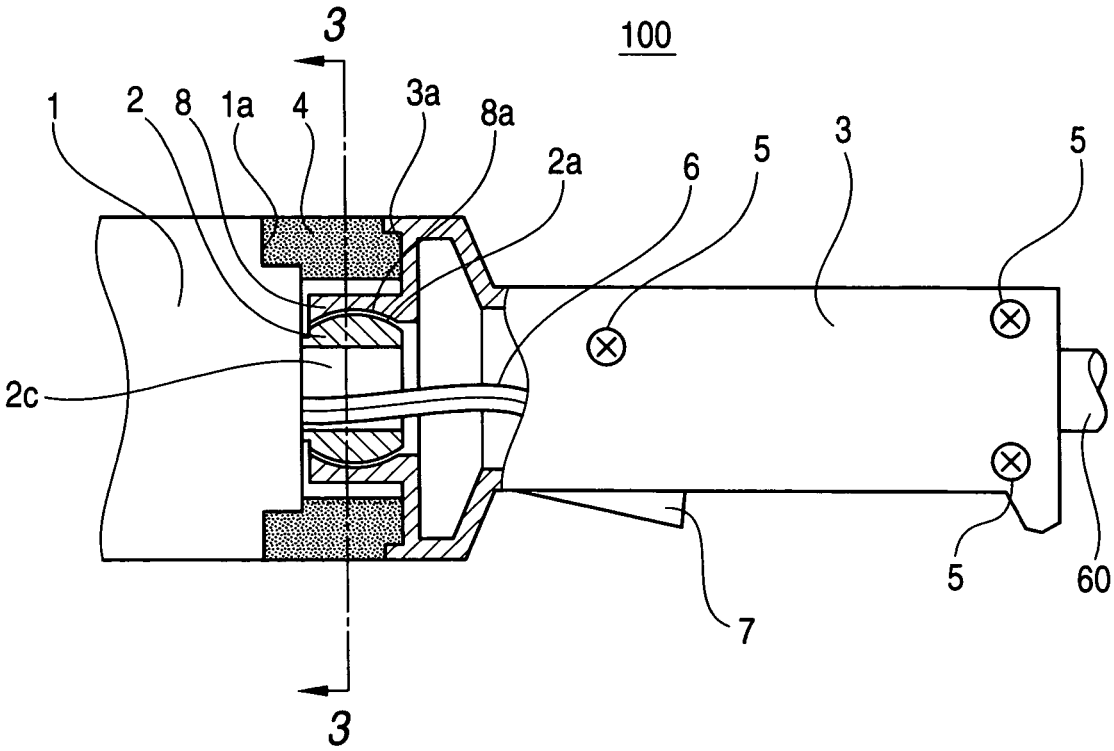
FIG. 2 is a partial longitudinal cross-sectional view of the power tool according to the first embodiment of the invention.
Figure 3:
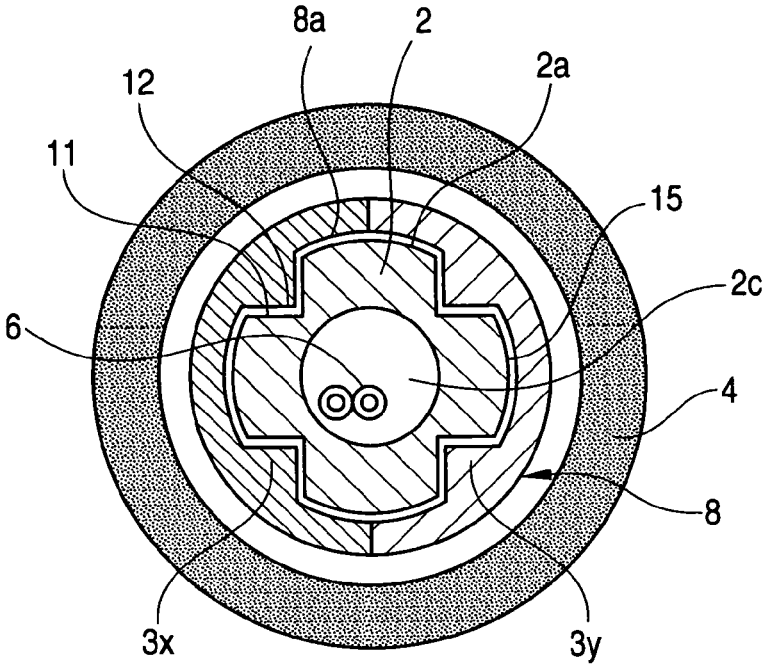
FIG. 3 is a cross-sectional view of the power tool according to the first embodiment of the invention, taken along the line 3-3 in FIG. 2.

FIG. 1 is an appearance view (side view) of a power tool according to a first embodiment of the present invention, in which a vibration isolating handle is applied to a disk grinder. FIG. 2 is a partial cross-sectional view (side view) of the power tool. FIG. 3 is a cross-sectional view of the power tool, taken along the line 3-3 in FIG. 2.

Referring firstly to FIG. 1, the appearance of the disk grinder according to the invention will be described below. The disk grinder 100 is roughly composed of a disk grinder main body (power tool main body) 1, a handle 3 and a power cord 60 for supplying the commercial AC power.

The power tool main body 1 comprises a motor portion housing 1*e* made of a metallic material, a gear portion housing (gear portion case) 1*f* made of a metallic material, a tip tool 1*h* composed of a disk-like grinder attached on a spindle 1*s*, and a protection cover 1*j* for protecting a part of the grinder. The motor portion housing 1*e* contains a universal motor, not shown, that is driven by AC power supplied through the power cord 60. A field core comprising a field winding of the universal motor or an armature shaft comprising an armature winding and a commutator are attached inside the motor portion housing 1*e*. Within the gear portion housing 1*f*, there are provided one pair of bevel gears, not shown, to change the direction of the turning force for a rotation shaft of the universal motor and transmit it to the spindle 1*s*. On the other hand, the handle 3 is composed of a case made of a plastic material, for example, in which a power switch 7 electrically connected to the power cord 60 and an electrical part for noise prevention are mounted within the case of this handle 3. An elastic body 4 according to the invention is inserted and fitted into a joint between an end portion of the motor portion housing 1*e* constituting a part of the power tool main body and the opposite end portion of the handle 3. The end portion of the motor portion housing 1*e* and the opposite end portion of the handle 3 carrying the elastic body 4 between them may be, but not limitative to, circular in cross section, in a direction vertical to the central axis. Accordingly, the cross sectional shape of the elastic body 4 carried between both has also a circular shape like a ring. The tool main body 1, the elastic body 4 and the handle 3 are integrated to constitute the power tool having the vibration isolating handle as described below.

FIG. 2 is an enlarged cross-sectional view (side view) of the joint between the power tool main body 1 and the handle 3. As shown in FIG. 2, a spherical handle holder 2 protrudes from an end portion of the power tool main body 1. The handle holder 2 has a spherical convex outer circumferential face (outer surface) 2*a*. That is, the outer circumferential face 2*a* has the convex outer surface 2*a* that is spherical radially outward from the central axis of the handle holder 2 in the protruding direction. A central portion of the handle holder 2 has a hollow portion 2*c* parallel to the central axis, and a commercial power feeder line 6 is disposed in this hollow portion 2*c*.

On the other hand, an arm portion 8 fitted with the handle holder 2 is provided at the end portion of the handle 3. The arm portion 8 has a spherical concave inner circumferential face (inner surface) 8*a*. This inner circumferential face 8*a* surrounds or covers the handle holder 2 to be fitted or engaged in a small gap with the outer circumferential face 2*a* of the handle holder 2. That is, the handle holder 2 is fitted to be slidable on the concave inner circumferential face 8*a* in the arm portion 8 of the handle 3, and inserted into the arm portion 8.

On the outer circumferential face 2*a* of the handle holder 2 as shown in FIG. 3, a depression portion 11 is disposed in at least one position on the outer circumference. Also, a projection portion 12 to engage the depression portion 11 provided on the outer circumferential face 2*a* of the handle holder 2 is disposed on the inner circumferential face 8*a* of the arm portion 8. Thereby, the handle holder 2 can be engaged without rotation around the central axis. Namely, the depression portion 11 and the projection portion 12 formed on both the spherical faces of convex and concave portions function as rotation prevention means of the handle holder 2 (or handle 3). Also, the elastic body 4 is disposed radially outside the arm portion 8 in cross section in the direction vertical to the central axis. This elastic body 4 is carried between the outer circumferential portion (end portion) 1*a* of the main body 1 of the power tool and the outer circumferential portion (end portion) 3*a* of the handle 3*a*.

Moreover, the handle 3 is divided in a direction parallel to the central axis into two handle members 3*x* and 3*y*, as shown in FIG. 3. The divided two handle members 3*x* and 3*y* are integrated by screws 5 (see FIG. 2). Though two handle members 3*x* and 3*y* are divided bilaterally in this embodiment, the handle 3 may be integrated of two or more handle members. The divided handle members are integrated by screws. In this way, the handle 3 is assembled from a plurality of handle members, whereby the assembling operation of fitting the arm portion 8 of the handle with the handle holder 2 is simplified.

With the above constitution of the handle holder 2 and the arm portion 8 of the handle 3, when the power tool main body 1 vibrates, the handle 3 is vibrated around the spherical center of the spherical convex outer circumferential face 2*a* of the handle holder 2. At this time, the outer circumferential face 2*a* of the spherical convex portion of the handle holder 2 slips or slides on the concave inner circumferential face 8*a* of the arm portion 8, compressing the ring-like elastic body 4 between the outer circumferential portion 1*a* of the tool main body and the outer circumferential portion 3*a* of the handle and absorbing the vibrations.

Even though the elastic body 4 is deteriorated due to secular change, the handle holder 2 and the handle 3 are not separated, because the outer circumferential face 2*a* of the spherical handle holder 2 and the inner circumferential face 8*a* of the arm portion 8 are fitted and linked in spherical face, whereby the safety operation is secured.

Moreover, the handle holder 2 can be engaged without rotation around the central axis by the depression portion 11 disposed on the outer circumferential face 2*a* of the handle holder 2 and the projection portion 12 disposed on the inner circumferential face 8*a* of the arm portion 8 to be engaged or fitted with the depression portion 11 in a cross section in the direction vertical to the central axis of the handle holder 2 and the handle 3, or in a cross section as shown in FIG. 3. Thereby, the rotation of the handle 3 is prevented, and the feeder line (electric wire) 6 electrically connected to the switch 7 within the handle 3 is not disconnected, even if it is wired in the hollow portion of the handle holder 2 and the handle 3. Particularly, this is effectively applied to the handle having specific directivity.

In the above embodiment, a slide member 15 made of fluororesin and having a small friction coefficient is provided on the surface of the outer circumferential face 2*a* of the handle holder 2 or the inner circumferential face 8*a* of the arm portion 8 to reduce the friction between the outer circumferential face 2*a* and the inner circumferential face 8*a*. Thereby, the handle 3 is more likely to oscillate with the power tool main body 1, and when the handle 3 is vibrated, the elastic body 4 can absorb the vibrations more efficiently.

Figure 4:
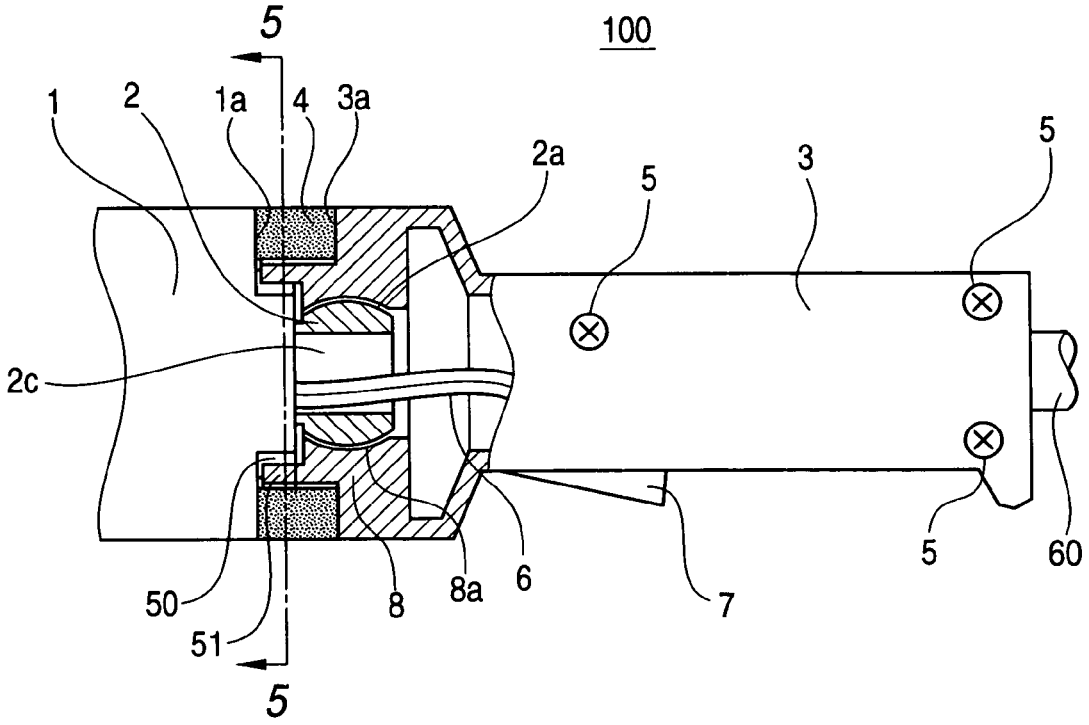
FIG. 4 is a partial longitudinal cross-sectional view of a power tool according to a second embodiment of the invention.
Figure 5:
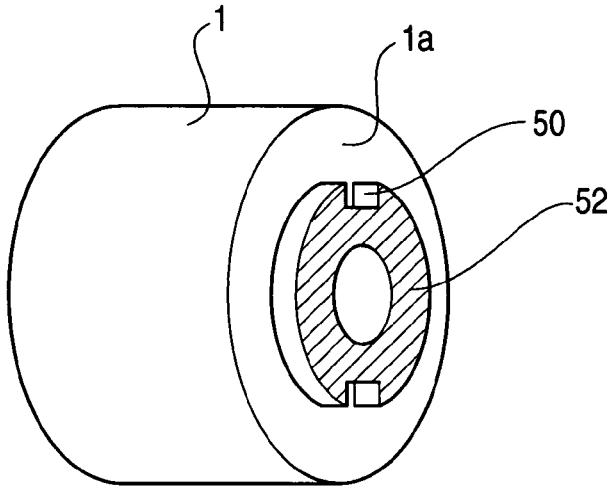
FIG. 5 is a cross-sectional view of the power tool according to the second embodiment of the invention, taken along the line 5-5 in FIG. 4.

Referring to FIGS. 4 and 5, a second embodiment of the invention as a modification of the first embodiment will be described below.

FIG. 4 is a partial cross-sectional view (side view) of a power tool according to the second embodiment, to which a disk grinder is applied. FIG. 5 is a partial perspective view of the power tool main body, broken away along the line 5-5 in FIG. 4. The overall appearance view of the second embodiment is the same as that of the first embodiment as shown in FIG. 1.

As shown in FIGS. 4 and 5, the handle holder 2 protruding from the power tool main body 1 has the spherical convex outer circumferential face (outer surface) 2*a* as in the first embodiment. Also, the arm portion 8 of the handle 3 has the spherical concave inner circumferential face (inner surface) 8*a* as in the first embodiment, in which the spherical convex outer circumferential face 2*a* is inserted and fitted with the spherical concave inner circumferential face 8*a*.

Though the depression portion 11 and the projection portion 12 are formed on both the spherical concave and convex faces of the spherical convex outer circumferential face 2*a* and the concave inner circumferential face 8*a* as the rotation prevention means of the handle holder 2 in the first embodiment, no rotation prevention means is formed on both the spherical concave and convex faces in this embodiment. As a variation technique of the rotation prevention means, a circular pedestal portion 52 is formed in a portion continuous to the handle holder 2 of the power tool main body 1 and a groove portion 50 is formed in an opposed portion of the circular outer circumference of the pedestal portion 52 in this embodiment, as shown in FIG. 5. This groove portion 50 is formed with a projection portion 51 of the arm portion 8 to be fitted with the groove portion 50 of the pedestal portion 52, as shown in FIG. 4. In contrast to the first embodiment, the groove portion 50 and the projection portion 51 are provided on the outer circumferential portion different from the convex outer circumferential face 2*a* and the concave inner circumferential face 8*a* to receive a moment more radially outward. Thereby, the groove portion 50 and the projection portion 51 are unlikely to break. With the above constitution, the elastic body 4 can absorb the vibrations in the same way as in the first embodiment.

Figure 6:
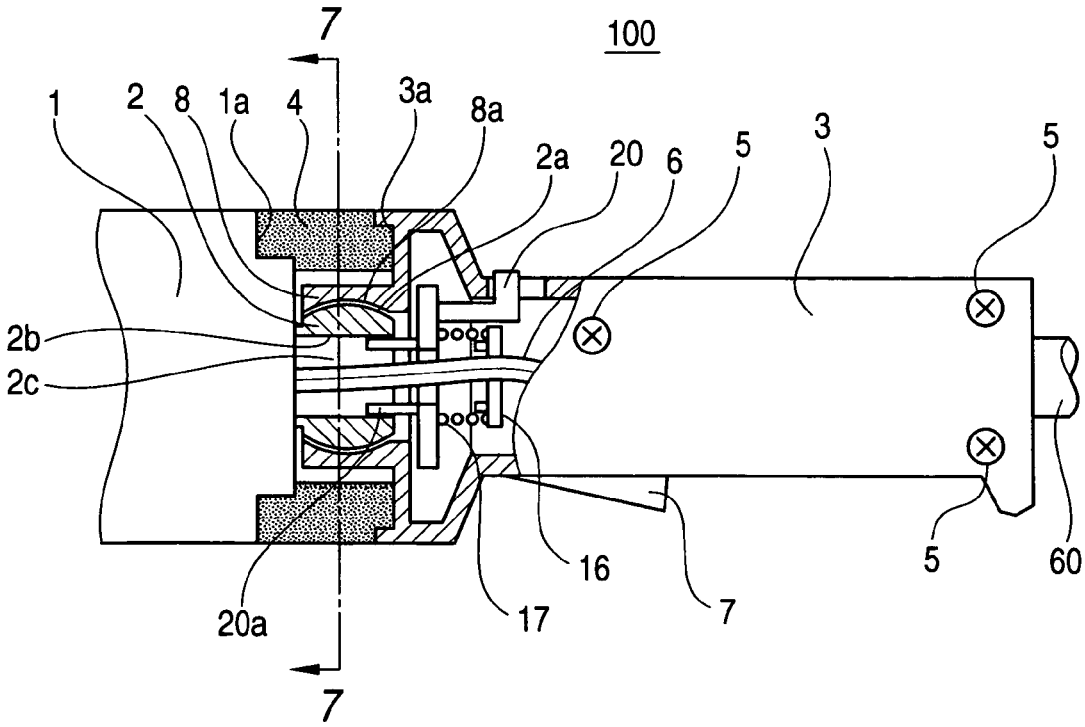
FIG. 6 is a partial longitudinal cross-sectional view of a power tool according to a third embodiment of the invention.
Figure 7:
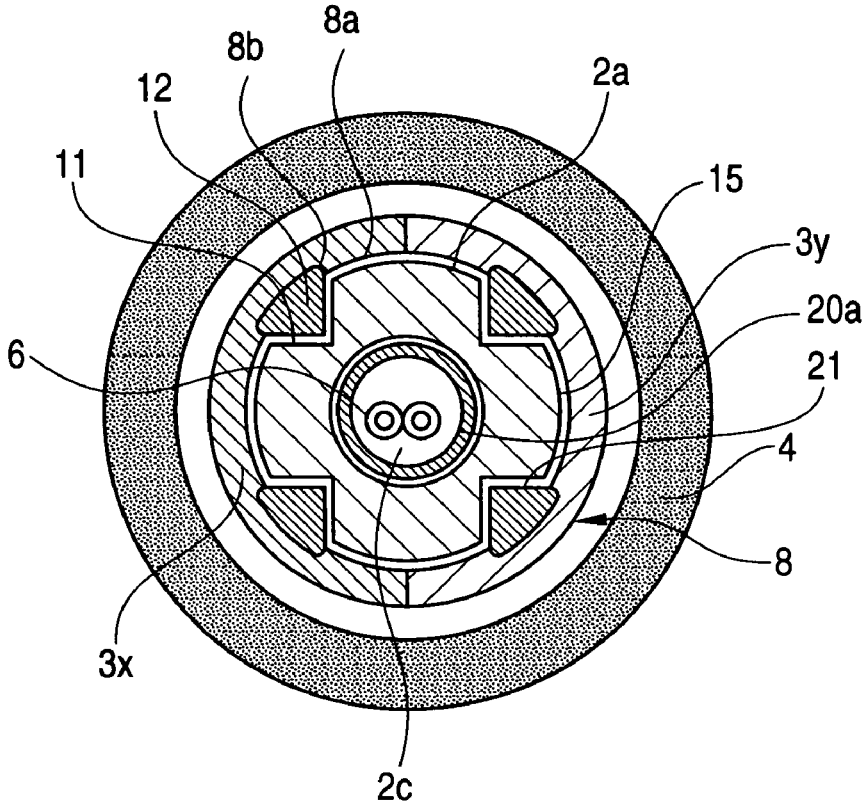
FIG. 7 is a cross-sectional view of the power tool according to the third embodiment of the invention, taken along the line 7-7 in FIG. 6.
Figure 8:
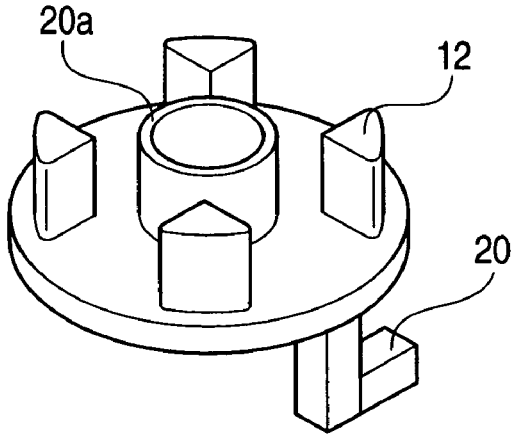
FIG. 8 is a perspective view of a slide switch for use in the third embodiment of the invention.

Referring to FIGS. 6, 7 and 8, a third embodiment of the invention will be described below.

FIG. 6 is a partial cross-sectional view (side view) of a power tool according to the third embodiment, to which a disk grinder is applied. FIG. 7 is a cross-sectional view along the line 7-7 in FIG. 6. FIG. 8 is a perspective view of a slide switch 20 for use in the third embodiment. The overall appearance view of the third embodiment is the same as that of the first embodiment as shown in FIG. 1.

As shown in FIGS. 6 and 7, the handle holder 2 protruding from the power tool main body 1 has the spherical convex outer circumferential face (outer surface) 2*a* as in the first embodiment. Also, the arm portion 8 of the handle 3 has the spherical concave inner circumferential face (inner surface) 8*a* as in the first embodiment, in which the spherical convex outer circumferential face 2*a* is inserted and fitted with the spherical concave inner circumferential face 8*a*.

The slide switch 20 contained within the handle 3 is provided with a barrel-like guide 20*a* engaging the inside of the cylindrical hollow portion 2*c* of the handle holder 2. That is, the outer surface of the barrel-like guide 20*a* is engaged, with a slight gap, with the hollow inner surface 2*b* of the handle holder 2. Also, the slide switch 20 is biased toward the power tool main body 1 by a spring 17 inserted into a plate 16 disposed within the handle 3.

Also, the projection portion 12 is disposed in the slide switch 20. The depression portion 8*b* is disposed on the spherical concave inner circumferential face 8*a* of the arm portion 8, corresponding to the depression portion 11 disposed on the spherical convex outer circumferential face 2*a* for the handle holder 2, whereby a hole portion 21 is partitioned by the depression portion 11 and the depression portion 8*b*. And the handle 3 is engaged in the handle holder 2 not to rotate by fitting the projection member 12 into the hole portion 21. Namely, the depression portion 11 and the projection member 12 function as the rotation prevention means of the handle holder 2 (or handle 3) as in the first embodiment.

On the other hand, in the power tool 100 such as disk grinder, the power tool main body 1 is rotated by 90 degrees around the central axis of the handle holder 2 to stand the tip tool 1*h* (see FIG. 1) vertically in cutting the concrete or iron material. At this time, the handle 3 is not rotated, but the switch 7 as shown in FIG. 6 is directed to the foot of the operator to allow the operator to perform the work more easily. In this third embodiment, the slide switch 20 as shown in FIG. 6 is moved against a load of the spring 17 and held in a moved state, so that the projection member 12 fitted into the hole portion 21 gets rid of the hole portion 21 to allow the handle 3 to be rotated. At this time, the operator can rotate the handle 3 by 90 degrees. A plurality of depression portions 11 disposed on the outer circumferential face of the handle holder 2 and a plurality of depression portions 8*b* disposed on the arm portion 8 are disposed to be opposed to each other in a state where the handle 3 is rotated by 90 degrees, and the new hole portion 21 is formed again by rotating the handle 3. The operator can engage the handle holder 2 with the arm portion 8 in a state where the handle 3 is rotated by 90 degrees by releasing the slide switch 20, and fitting the projection member 12 into the new hole portion 21 again.

With the above constitution, the elastic body 4 can absorb the vibrations in the same way as in the first embodiment, and the handle 3 can be rotated by 90 degrees and held according to the working substance, whereby the vibration isolating handle having excellent operability can be provided.

Figure 9:
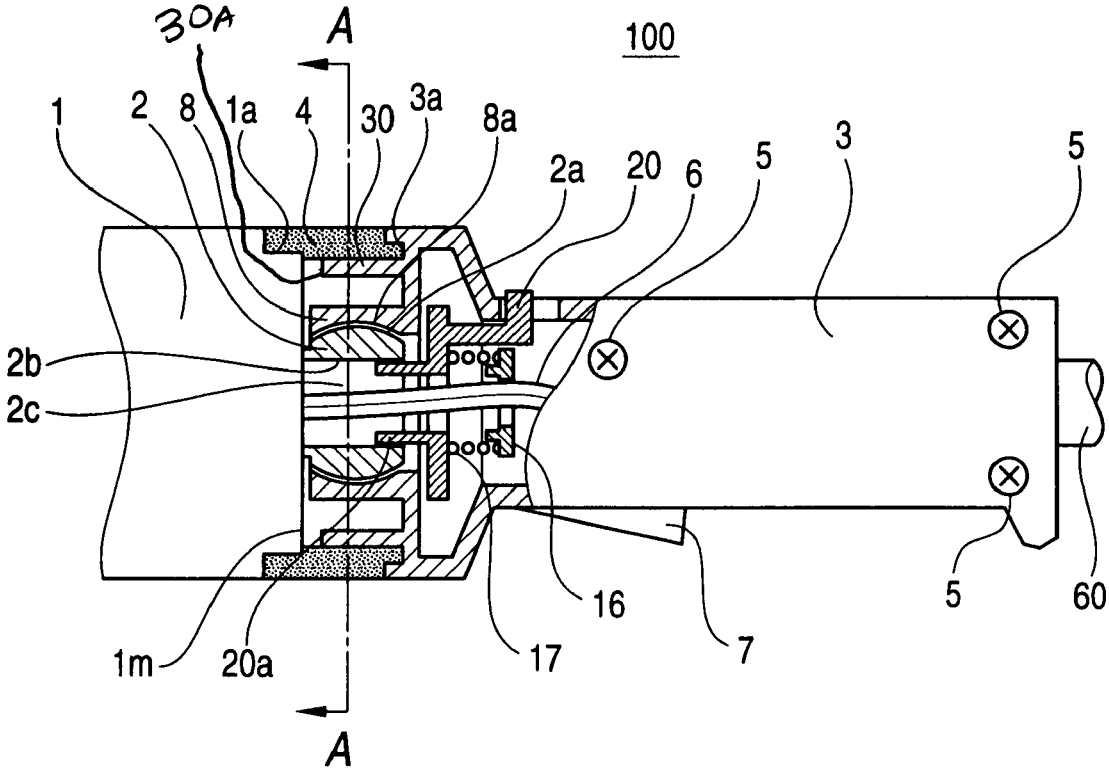
FIG. 9 is a partial longitudinal cross-sectional view of a power tool according to a fourth embodiment of the invention.
Figure 10:
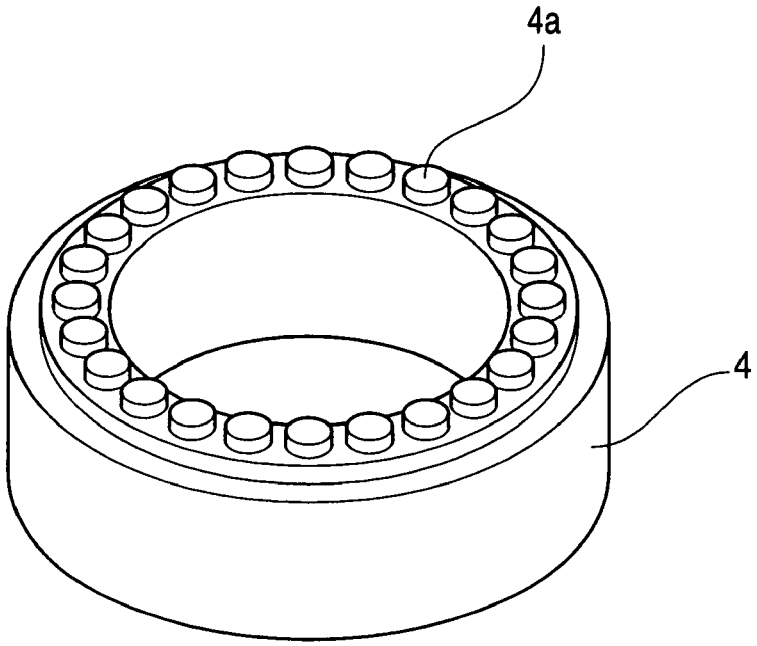
FIG. 10 is a perspective view of an elastic body for use in the fourth embodiment of the invention.

Referring now to FIGS. 9 and 10, a fourth embodiment of the invention will be described below. FIG. 9 is a partial cross-sectional view (side view) of a power tool of the disk grinder having the vibration isolating handle according to the fourth embodiment. FIG. 10 is a perspective view of the elastic body 4 used in the fourth embodiment.

The handle holder 2 and the arm portion 8 of the handle 3 have the same shape and structure as in the first and third embodiments. A different point from the above embodiments is that a stopper (projection portion) 30 directing toward the power tool main body 1 is placed at a position on the outer diameter side of the arm portion 8 of the handle 3 and on the inner diameter side of the elastic body 4 in a direction vertical to the central axis of the handle holder as shown in FIG. 9. A distal end 30*a* of the stopper 30 does not reach the end portion of the power tool main body 1 so that there is a gap between the power tool main body 1 and it. Also, the elastic body 4 is provided with a projection portion 4*a* at one end contact with the handle 3 or the other end contact with the power tool main body 1, as shown in FIG. 10. The projection portion 4*a* of the elastic body 4 may be formed on either end portion.

In this fourth embodiment, if the stopper or projection portion 30 is not provided, the operator holds the handle 3, and lays a big load on the power tool main body 1, the elastic body 4 is locally compressed to cause the handle 3 to be greatly flexed. As a result, the elastic body 4 is subject to excessive distortion, possibly breaking the elastic body 4. However, according to this invention, if the stopper 30 is placed on the handle 3, the distal end 30*a* of the stopper 30 makes contact with the stopper acceptance portion 1*m* of the tool main body 1, in a process where the handle 3 is flexed, whereby the elastic body 4 has no excessive distortion. Under this action, the flexure of the handle 30 is suppressed, and the breakage of the elastic body 4 is prevented.

According to this invention, the length of the elastic body 4 in a direction parallel to the central axis of the handle holder 2 is made larger than the length of a gap accommodating the elastic body 4 between the outer circumferential portion 1*a* of the main body 1 and the outer circumferential portion 3*a* of handle, and a plurality of projections 4*a* are disposed on the contact face between the elastic body 4 and the outer circumferential portion 1*a* of the main body 1 or the outer circumferential portion 3*a* of the handle 3.

Generally, it is well known that if the power tool having the vibration isolating handle with the elastic body is employed for a long time, a gap occurs between the handle and the elastic body due to permanent deformation of the elastic body, so that the elastic body is loosely fitted. In this case, it is difficult for the operator to hold the handle of the power tool and move the power tool main body to a predetermined position, resulting in a problem that the power tool has poor operability.

According to the invention, owing to provision of the projection portion 4*a*, when the handle holder 2 and the handle 3 are assembled, the concave and convex portions having low rigidity are significantly deformed at first, suppressing a reaction force due to deformation of the elastic body 4, and improving the operability at the time of assembling. Also, even if the elastic body 4 is permanently deformed during the use of the tool for the long time, no gap occurs, because the length of the elastic body 4 is made longer than the length of the gap between the outer circumferential portion 1*a* of the main body and the outer circumferential portion 3*a* of the handle. Accordingly, the power tool having the vibration isolating handle has excellent operability.

Figure 11:
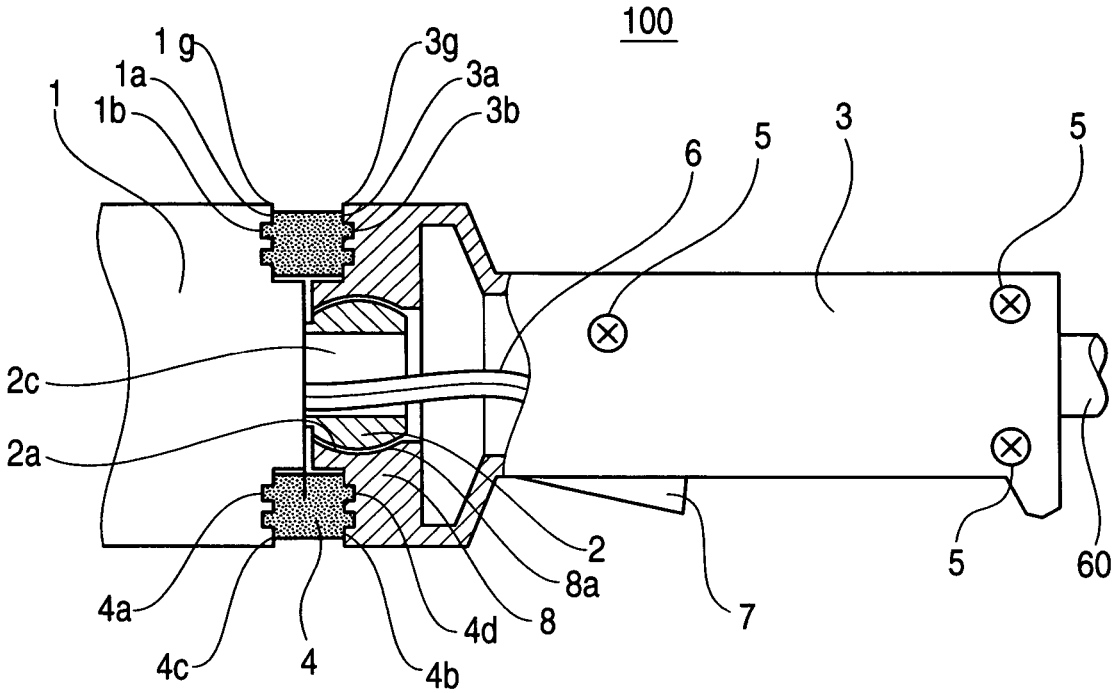
FIG. 11 is a partial longitudinal cross-sectional view of a power tool according to a fifth embodiment of the invention.
Figure 12:
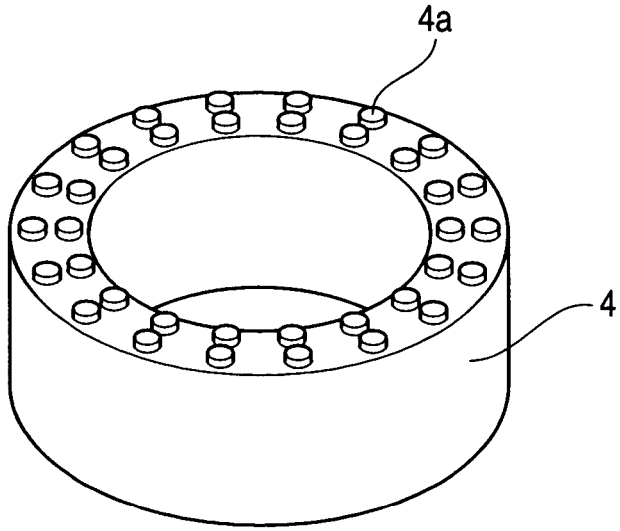
FIG. 12 is a perspective view of an elastic body for use in the fifth embodiment of the invention.

Referring now to FIGS. 11 and 12, a fifth embodiment of the invention will be described below.

FIG. 11 is a partial cross-sectional view (side view) of a power tool of the disk grinder having the vibration isolating handle according to the invention. FIG. 12 is a perspective view of the elastic body 4.

The handle holder 2 and the arm portion 8 of the handle 3 have the same shape and structure as in the first to third embodiments. A different point from the above embodiments is that the structure of the elastic body 4 carried between the tool main body 1 and the handle 3 or the arm portion 8 is deformed, as shown in FIG. 11 and FIG. 12.

The projection portions 4*a* and 4*d* are disposed on both the contact face 4*c* of the elastic body 4 with the outer circumferential portion 1*a* of the tool main body and the contact face 4*b* of the elastic body 4 with the outer circumferential portion 3*a* of the handle, and the groove portions 1*b* and 3*b* to be fitted around the projections 4*a* and 4*d* disposed on the elastic body 4 are disposed on the outer circumferential portion 1*a* of the main body and the outer circumferential portion 3*a* of the handle that are opposed.

Also, on the outer circumferential portion of the contact face with the power tool main body 1 and the handle 3, the projection portions 1*g* and 3*g* are disposed to suppress deformation of the elastic body 4 radially outward.

When the operator operates this power tool 100, the operator presses the handle 3 with the root of the forefinger and grasps the handle 3 with the little finger to raise it. At this time, the handle 3 is inclined so that the rear end of the handle 3 is lifted up with respect to the central axis line of the power tool main body 1, compressing the elastic body 4 between the outer circumferential portion 3*a* of the handle and the outer circumferential portion of the power tool main body 1*a*. As a result, the elastic body 4 is elongated radially outward of the power tool main body 1 due to elastic deformation, producing a slippage on the contact face between the elastic body 4 and the power tool main body 1 and the elastic body 4 and the handle 3. However, according to the invention, the concave and convex portions to be fitted together are formed the contact face, thereby preventing a slippage on the contact face between the handle 3 and the elastic body 4.

The effect of suppressing slippage on the contact face with the elastic body 4 is increased by disposing the fitting portions in at least two positions radially on the contact face. Further, the effect is more remarkable by disposing the fitting portions in at least two or more positions within an angle of 45° circumferentially on the contact face of the elastic body 4.

Also, the radially outward deformation of the outermost circumferential portion of the elastic body 4 is suppressed by the projection portion 1*g* disposed in the power tool main body 1 and the projection portion 3*g* disposed in the handle 3, thereby preventing slippage on the outermost circumferential portion of the contact faces 4*c* and 4*b* of the elastic body 4. Thus, the slippage on the contact face of the elastic body 4 is eliminated, whereby the vibration isolating handle with excellent operability and less secular change can be provided.

As a result, the initial deflection amount of the handle 3 when the operator grasps the handle 3 is caused only by deformation of the elastic body 4, and suppressed more effectively than with slippage, whereby the operator is increased in the reliability of operating the handle 3.

In operation, when the power tool main body 1 is vibrated while the operator takes hold of the handle 3, there is no slippage on the contact face 4*b* between the elastic body 4 and the handle 3 and the contact face 4*c* between the elastic body 4 and the power tool main body 1, whereby the vibration can be absorbed only owing to the effect of the deformation of the elastic body 4. Accordingly, there is no wear on the contact faces 4*c* and 4*b* of the elastic body 4, whereby the performance can be maintained for the long term.

Though the shape of the joint between the power tool and the handle is circular in cross section in the above embodiments, the invention is also applicable to the rectangular shape. In this case, the sectional shape of the elastic body is rectangular shape of ring. Also, though the elastic body is assembled as a simplex having the shape of ring in the above embodiment, a plurality of ring shapes for the elastic body may be integrated and assembled.

Moreover, though the power tool is the disk grinder in the above embodiments, the invention may be applicable to other power tools.

As will be apparent from the above explanation, with the invention, the handle holder having the spherical convex outer circumferential face and the handle with the arm portion having the spherical concave inner circumferential face are fitted together, and the elastic body is carried between the handle holder and the handle on the outer circumferential portion of the fitted portion, whereby the vibration isolating handle having excellent operability and less secular change can be provided.

Though the invention achieved by the present inventor has been specifically described above on the basis of the embodiments of the invention, the invention is not limited to the above embodiments, but various modifications may be made without departing from the spirit or scope of the invention.

With the invention, the handle holder has a spherical convex outer circumferential face, and the arm portion surrounding the handle holder has a spherical concave inner circumferential face, the convex outer circumferential face of the handle holder being inserted and fitted into the concave inner circumferential face of the arm portion, and the elastic body is carried between the power tool main body and the handle around the outer circumference of the handle holder in a radial direction vertical to the central axis of the handle holder in the protruding direction, whereby the concave inner circumferential face and the convex outer circumferential face acting as anti-slip of the handle are placed in an overlap state with the elastic body in the direction of the central axis. Also, since the elastic body for vibration absorption is carried between the power tool main body and the handle, it is unnecessary to provide the rib to demarcate the space that contains the elastic body. Hence, it is possible to provide the power tool that can absorb the vibrations efficiently and has a small size.

Also, the elastic body is carried between the power tool and the handle, the first contact face between one end of the elastic body and the power tool main body and the second contact face between the other end of the elastic body and the handle are provided with the concave and convex fitting portions that can be fitted together, or the length of the elastic body in the direction parallel to the central axis of the handle holder is greater than the size of the gap for the elastic body carried and contained between the power tool main body and the handle to form the convex and concave portions contacting the handle or the power tool main body, making it possible to eliminate the slippage on the contact face, whereby the operability or workability can be improved. Also, it is possible to provide the vibration isolating handle with less secular change.

Further, owing to the devised shape of the handle holder and handle and the installation of the slide switch, the handle can be held in a state where it is rotated by 90 degrees, whereby it is possible to provide the power tool having the vibration isolating handle that is excellent in the workability, can absorb the vibrations efficiently and has a small size.

Also, since the handle is composed of a plurality of handle members divided in the direction parallel to the central axis of the handle holder, and the elastic body has a shape of ring, the assembly may be performed in accordance with the following procedure. That is, the elastic body is incorporated around the outer circumference of the handle holder, and then each of the divided handle members is incorporated from behind the elastic body so that the concave inner circumferential face and the convex inner circumferential face may be engaged. At this time, if the axial length of the elastic body is set longer than the gap where the elastic body is contained, the elastic body presses the handle axially to prevent the handle member from entering deeply. With this invention, the convex outer circumferential face and the concave inner circumferential face are formed as spherical, whereby if the divided handle members are joined by screws in this state, the handle members enter deeply against the elastic body due to inclination of the convex outer circumferential face and the concave inner circumferential face. Thereby, the assembling operation of the power tool is simplified.

What is claimed is:

1. A power tool comprising:

a power tool main body;

a handle holder protruding from the power tool main body;

a handle extending in a protruding direction of the handle holder and having an arm portion directly engaging the handle holder; and an elastic body carried between, and engaging, the power tool main body and the handle, wherein the handle holder has a convex outer circumferential face, wherein the arm portion surrounds the handle holder and has a concave inner circumferential face, wherein the convex outer circumferential face of the handle holder is inserted and fitted into the concave inner circumferential face of the arm portion, wherein the elastic body has a circular shape and is carried between, and engages, the power tool main body and the handle so as to surround the outer circumference of the handle holder in a direction concentric to a protruding-direction central axis of the handle holder, wherein the elastic body absorbs forces between the power tool main body and the handle caused by pivoting of the power tool main body relative to the handle, and wherein a movement of the convex outer circumferential face in a direction perpendicular to the protruding direction of the handle holder is regulated by the concave inner circumferential face.

2. The power tool according to claim 1, further comprising:

a rotation prevention unit disposed between the handle holder and the arm portion;

wherein the rotation prevention unit prevents a rotation around the protruding-direction central axis of the handle holder.

3. The power tool according to claim 1, wherein at least two first depression portions that are separated from each other and that extend in the direction parallel to the protruding-direction central axis of the handle holder in the protruding direction are formed on a part of the convex outer circumferential face;

wherein at least two second depression portions that are separated from each other and that are formed on the concave inner circumferential face so as to correspond to the first depression portions;

wherein when the first depression portions and the second depression portions are contacted, at least two separated holes portions with the handle holder and the arm portion as the side walls are formed;

wherein the handle has a slide switch accommodated therein, the slide switch being slidable in a direction of the protruding-direction central axis of the handle holder; and wherein the slide switch is provided with a projection portion thereon, the projection portion fittable into the hole portion formed by the handle holder and the arm portion.

4. The power tool according to claim 1, wherein a slide member is disposed on the convex outer circumferential face of the handle holder or the concave inner circumferential face of the arm portion.

5. The power tool according to claim 1, wherein the handle includes a plurality of handle members divided in the direction parallel to the protruding-direction central axis of the handle holder.

6. The power tool according to claim 1, wherein the elastic body has a shape of a ring in cross section in the radial direction vertical to the protruding-direction central axis of the handle holder.

7. The power tool according to claim 1, further comprising:

a projection portion projecting in the direction of the power tool main body and being disposed at a position on the outer diameter side of an arm of the handle and on the inner diameter side of the elastic body;

wherein a gap is defined between a distal end of the projection portion and the power tool main body.

8. A power tool comprising:

a power tool main body;

a handle holder protruding from the power tool main body;

a handle extending in a protruding direction of the handle holder and having an arm portion directly engaging the handle holder; and an elastic body carried between, and engaging, the power tool main body and the handle, wherein the elastic body has a circular shape and is carried between, and engages, the power tool main body and the handle so as to surround the outer circumference of the handle holder in a direction concentric to a protruding-direction central axis of the handle holder, wherein the elastic body absorbs forces between the power tool main body and the handle caused by pivoting of the power tool main body relative to the handle, and wherein a movement of a convex outer circumferential face of the handle holder in a direction perpendicular to the protruding direction of the handle holder is regulated by a concave inner circumferential face of the arm portion.

9. The power tool according to claim 8, further comprising:

a rotation prevention unit disposed between the handle holder and the arm portion, wherein the rotation prevention unit prevents a rotation around the protruding-direction central axis of the handle holder.

10. The power tool according to claim 8, wherein at least two first depression portions that are separated from each other and that extend in the direction parallel to the protruding-direction central axis of the handle holder in the protruding direction are formed on a part of the joint portion;

wherein at least two second depression portions that are separated from each other and that are formed on the joint portion face so as to correspond to the first depression portions;

wherein when the first depression portions and the second depression portions are contacted, at least two separated holes portions with the handle holder and the arm portion as the side walls are formed;

wherein the handle has a slide switch accommodated therein, the slide switch being slidable in a direction of the protruding-direction central axis of the handle holder; and wherein the slide switch is provided with a projection portion thereon, the projection portion fittable into the hole portion formed by the handle holder and the arm portion.

11. The power tool according to claim 8, wherein a slide member is disposed on the handle holder or the arm portion.

12. The power tool according to claim 8, wherein the handle includes a plurality of handle members divided in the direction parallel to the protruding-direction central axis of the handle holder.

13. The power tool according to claim 8, wherein the elastic body has a shape of a ring in cross section in the radial direction vertical to the protruding-direction central axis of the handle holder.

14. The power tool according to claim 8, further comprising:

a projection portion projecting in the direction of the power tool main body and being disposed at a position on the outer diameter side of an arm of the handle and on the inner diameter side of the elastic body, wherein a gap is defined between a distal end of the projection portion and the power tool main body.

15. A power tool comprising:

a power tool main body;

a handle holder protruding from the power tool main body;

a handle extending in a protruding direction of the handle holder and having an arm portion directly engaging the handle holder; and an elastic body carried between, and engaging, the power tool main body and the handle, wherein the handle holder has a convex outer circumferential face, wherein the arm portion surrounds the handle holder and has a concave inner circumferential face, wherein the convex outer circumferential face of the handle holder is inserted and fitted into the concave inner circumferential face of the arm portion, wherein the elastic body has a circular shape and is carried between, and engages, the power tool main body and the handle so as to surround the outer circumference of the handle holder in a direction concentric to a protruding-direction central axis of the handle holder, wherein the elastic body absorbs forces between the power tool main body and the handle caused by pivoting of the power tool main body relative to the handle, wherein a movement of the convex outer circumferential face in the protruding direction of the handle holder is regulated by the concave inner circumferential face, and wherein the concave inner circumferential face of the arm portion rotates while being guided by the convex outer circumferential face of the handle holder when the handle rotates about a central axis in the protruding direction of the handle holder.

16. A power tool comprising:

a power tool main body;

a handle holder protruding from the power tool main body;

a handle extending in a protruding direction of the handle holder and having an arm portion directly engaging the handle holder; and an elastic body carried between, and engaging, the power tool main body and the handle, wherein the elastic body has a circular shape and is carried between, and engages, the power tool main body and the handle so as to surround the outer circumference of the handle holder in a direction concentric to a protruding-direction central axis of the handle holder, wherein the elastic body absorbs forces between the power tool main body and the handle caused by pivoting of the power tool main body relative to the handle, wherein a movement of a convex outer circumferential face of the handle holder in the protruding direction of the handle holder is regulated by a concave inner circumferential face of the arm portion, and wherein the concave inner circumferential face of the arm portion rotates while being guided by the convex outer circumferential face of the handle holder when the handle rotates about a central axis in the protruding direction of the handle holder.

* * * * *